US012662817B2

(12) United States Patent
Rufus et al.

(10) Patent No.: US 12,662,817 B2
(45) Date of Patent: Jun. 23, 2026

(54) ROOFING MATERIALS AND ROOFING SYSTEMS WITH IMPROVED FIRE RESISTANCE AND METHODS OF MAKING THEREOF

(71) Applicant: BMIC LLC, Dallas, TX (US)

(72) Inventors: Isaac Bernard Rufus, Newark, DE (US); Adem Chich, Kearny, NJ (US); Richard Chin, Livingston, NJ (US); Michael Dougherty, Mount Arlington, NJ (US); Overton Williams, Paterson, NJ (US)

(73) Assignee: BMIC LLC, Dallas, TX (US)

( * ) Notice: Subject to any disclaimer, the term of this patent is extended or adjusted under 35 U.S.C. 154(b) by 184 days.

(21) Appl. No.: 17/881,980

(22) Filed: Aug. 5, 2022

(65) Prior Publication Data

US 2023/0050372 A1 Feb. 16, 2023

Related U.S. Application Data

(60) Provisional application No. 63/230,160, filed on Aug. 6, 2021.

(51) Int. Cl.

| | |
|---|---|
| ***E04D 5/00*** | (2006.01) |
| ***E04D 5/02*** | (2006.01) |
| ***E04D 5/06*** | (2006.01) |
| ***E04D 5/10*** | (2006.01) |

(52) U.S. Cl.

CPC ..... *E04D 5/10* (2013.01); *E04D 5/02* (2013.01); *E04D 5/06* (2013.01)

(58) Field of Classification Search

CPC .... E04D 5/02; E04D 5/06; E04D 5/08; E04D 5/10

See application file for complete search history.

(56) References Cited

U.S. PATENT DOCUMENTS 3,900,102 A * 8/1975 Hurst ..... C09J 7/241 428/41.3
6,500,560 B1 * 12/2002 Kiik ..... E04B 1/665 428/323
6,586,353 B1 * 7/2003 Kiik ..... C03C 17/38 428/323

(Continued)

FOREIGN PATENT DOCUMENTS

CA 2680297 C 8/2016

OTHER PUBLICATIONS

International Search Report and Written Opinion for International Patent Application No. PCT/US22/39556 dated Dec. 6, 2022.

*Primary Examiner* — Kyle J. Walraed-Sullivan
(74) *Attorney, Agent, or Firm* — Venable LLP

(57) ABSTRACT

This invention, in embodiments, relates to a roll comprising a roofing material. The roofing material includes a substrate having a first side and a second side, and a film layer attached to at least one of the first side or the second side of the substrate, the film layer comprising a polymer and having a thickness of 0.5 mils to 100 mils. A single layer of the roofing material achieves a Class A rating for steep slope roofing systems when tested according to UL 790 and/or ASTM E-108 Standard Test Methods for Fire Tests of Roof Coverings. This invention, in embodiments, further relates to a roofing material and a steep slope roofing system.

9 Claims, 4 Drawing Sheets

(56) References Cited

U.S. PATENT DOCUMENTS 6,632,509 B1 * 10/2003 Davis ..... C08L 23/16 524/412
6,849,338 B2 * 2/2005 Clemens ..... B05D 7/54 428/424.2
7,592,066 B2 * 9/2009 Shiao ..... C23C 14/205 427/446
7,878,301 B2 * 2/2011 Gross ..... D04H 1/43828 181/290
8,178,449 B2 * 5/2012 La Vietes ..... E04D 12/002 428/921
10,245,816 B2 * 4/2019 Kalkanoglu ..... B32B 5/022
11,384,541 B2 * 7/2022 Verhoff ..... B05D 1/36
2004/0244316 A1 * 12/2004 Macuga ..... C09J 7/22 52/198
2005/0142330 A1 * 6/2005 Albert ..... B44F 5/00 428/143
2007/0194482 A1 * 8/2007 Douglas ..... B32B 27/32 264/173.14
2008/0152867 A1 * 6/2008 Di Pede ..... B32B 5/024 427/256
2008/0229320 A1 9/2008 Ueda
2009/0241450 A1 10/2009 Italiane et al.
2011/0011021 A1 * 1/2011 LaVietes ..... C09D 5/18 524/437
2014/0150960 A1 * 6/2014 Peng ..... B32B 27/32 156/244.11
2014/0215937 A1 * 8/2014 Zhou ..... D06N 5/00 428/221
2015/0240494 A1 * 8/2015 Kiik ..... C09D 195/00
2015/0259919 A1 9/2015 Lewis
2016/0354993 A1 * 12/2016 Grube ..... B32B 5/02
2017/0015042 A1 1/2017 Leitch et al.
2019/0077700 A1 3/2019 Xu et al.
2019/0344542 A1 * 11/2019 Seth ..... B32B 7/12
2019/0359871 A1 * 11/2019 Hartmann ..... C08F 220/1818
2021/0340768 A1 * 11/2021 Ferreira Peralta ..... B32B 7/027
2024/0044132 A1 * 2/2024 Chich ..... C09D 7/61

* cited by examiner

ROOFING MATERIALS AND ROOFING SYSTEMS WITH IMPROVED FIRE RESISTANCE AND METHODS OF MAKING THEREOF

This application claims the priority of U.S. provisional application Ser. No. U.S. 63/230,160, entitled "Roofing Materials and Roofing Systems With Improved Fire Resistance And Methods of Making Thereof" filed Aug. 6, 2021, which is incorporated herein by reference in its entirety for all purposes.

FIELD OF THE INVENTION

This invention relates to roofing materials and roofing systems with improved fire resistance and methods of making such roofing materials. The roofing materials include a substrate and a polymeric film layer attached to the substrate. Roofing materials, such as shingles, and roofing systems, including steep slope roofing systems, having this polymeric film layer exhibit superior properties of, for example, improved fire resistance, as compared to other roofing materials and roofing systems.

BACKGROUND OF THE INVENTION

Typically, roofing materials, such as, e.g., shingles, are based upon a fiberglass or felt mat that is coated and impregnated with an asphalt-based composition that is subsequently coated with granules.

Air blown asphalt and polymer-modified asphalt have been used as roofing shingle coating materials for many years. However, asphalts of suitable quality are becoming less available, and their price is increasing. Also, fluctuations in the quality of asphalt streams can create processing problems and increase operating costs at asphalt processing plants. Moreover, setting up facilities for handling and processing of asphalt-based coating materials can be very costly. These costs are associated with putting in place asphalt and/or additive holding tanks, asphalt heating systems, air blowing stills/compressors, fume incineration systems, mixers and tank agitators and specialized hot liquid loading/unloading stations. The requirement for permits relating to environmental regulations further adds to the overall costs.

There is thus a need for alternative and/or hybrid roofing materials that are not based entirely upon asphalt, such as, e.g., substrates having film layers that are comprised of various polymeric materials that further provide improved fire resistance.

SUMMARY OF THE INVENTION

One embodiment of this invention pertains to a roll comprising a roofing material. The roofing material includes a substrate having a first side and a second side, and a film layer attached to at least one of the first side or the second side of the substrate, the film layer comprising a polymer and having a thickness of 0.5 mils to 100 mils. The roofing material, when applied in a single layer and tested according to UL 790 and/or ASTM E-108 Standard Test Methods for Fire Tests of Roof Coverings, achieves a Class A rating for steep slope roofing systems single.

In an embodiment, the substrate comprises at least one of a scrim, a fiberglass mat, a polymer mat, or a hybrid mat. In another embodiment, the substrate comprises at least one of a polyolefin base mat or a polyester mat.

In one embodiment, the substrate includes a coating applied onto the substrate, and the coating comprises at least one of asphalt, a polymer-modified asphalt, or a non-asphaltic polymeric coating.

In one embodiment, the polymer comprises at least one of polyvinylidene fluoride (PVDF), polyvinyl chloride (PVC), or silicone.

In an embodiment, the film layer further comprises at least one of a filler, a pigment, a dye, a colorant, a fire retardant, a UV absorber, an anti-oxidant, a hindered amine light stabilizer (HALS), an impact modifier, a fiber, a wear resistance hard particle, an anti-microbial additive, an anti-fungal additive, or an anti-algae additive.

In an embodiment, the film layer has a thickness of 5 mils to 20 mils. In an embodiment, the film layer has a thickness of 10 mils to 20 mils.

In an embodiment, the film layer is attached to both the first side and the second side of the substrate.

In one embodiment, the film layer is metallized.

In an embodiment, the roofing material further comprises a reinforcement layer. In one embodiment, the reinforcement layer comprises at least one of a scrim, a fiberglass mat or a polyester mat.

Another embodiment of this invention pertains to a roofing material that includes a substrate having a first side and a second side, and a film layer attached to at least one of the first side or the second side of the substrate, the film layer comprising a polymer and having a thickness of 0.5 mils to 100 mils. The roofing material, when applied in a single layer and tested according to UL 790 and/or ASTM E-108 Standard Test Methods for Fire Tests of Roof Coverings, achieves a Class A rating for steep slope roofing systems.

In an embodiment, the substrate comprises at least one of a scrim, a fiberglass mat, a polymer mat, or a hybrid mat. In another embodiment, the substrate comprises at least one of a polyolefin base mat or a polyester mat.

In one embodiment, the substrate includes a coating applied onto the substrate, and the coating comprises at least one of asphalt, a polymer-modified asphalt, or a non-asphaltic polymeric coating.

In one embodiment, the polymer comprises at least one of polyvinylidene fluoride (PVDF), polyvinyl chloride (PVC), or silicone.

In an embodiment, the film layer further comprises at least one of a filler, a pigment, a dye, a colorant, a fire retardant, a UV absorber, an anti-oxidant, a hindered amine light stabilizer (HALS), an impact modifier, a fiber, a wear resistance hard particle, an anti-microbial additive, an anti-fungal additive, or an anti-algae additive.

In an embodiment, the film layer has a thickness of 5 mils to 20 mils. In an embodiment, the film layer has a thickness of 10 mils to 20 mils.

In an embodiment, the film layer is attached to both the first side and the second side of the substrate.

In one embodiment, the film layer is metallized.

In an embodiment, the roofing material is a roofing shingle. According to one embodiment, the roofing shingle is one of (i) a single layer shingle or (ii) a laminated shingle having two or more layers.

In an embodiment, the roofing material further includes granules. In another embodiment, the roofing material further comprises fines.

In an embodiment, the roofing material further comprises a reinforcement layer. In one embodiment, the reinforcement layer comprises at least one of a scrim, a fiberglass mat or a polyester mat.

Another embodiment of this invention pertains to a steep slope roofing system comprising a roof deck and a roofing material positioned above the roof deck. The roofing material includes a substrate having a first side and a second side, and a film layer attached to at least one of the first side or the second side of the substrate, the film layer comprising a polymer and having a thickness of 0.5 mils to 100 mils. The roof deck is a steep slope roof deck having a pitch of Y/X, wherein Y and X are in a ratio of 2:12 to 12:12, with Y corresponding to the rise of the roof and X corresponding to the run of the roof. The roofing system, when tested according to UL 790 and/or ASTM E-108 Standard Test Methods for Fire Tests of Roof Coverings, achieves a Class A rating for steep slope roofing systems.

In an embodiment, the roof deck is a steep slope roof deck having a pitch of Y/X, wherein Y and X are in a ratio of 4:12 to 12:12, with Y corresponding to the rise of the roof and X corresponding to the run of the roof.

In an embodiment, the substrate comprises at least one of a scrim, a fiberglass mat, a polymer mat, or a hybrid mat. In another embodiment, the substrate comprises at least one of a polyolefin base mat or a polyester mat.

In one embodiment, the substrate includes a coating applied onto the substrate, and the coating comprises at least one of asphalt, a polymer-modified asphalt, or a non-asphaltic polymeric coating.

In one embodiment, the polymer comprises at least one of polyvinylidene fluoride (PVDF), polyvinyl chloride (PVC), or silicone.

In an embodiment, the film layer further comprises at least one of a filler, a pigment, a dye, a colorant, a fire retardant, a UV absorber, an anti-oxidant, a hindered amine light stabilizer (HALS), an impact modifier, a fiber, a wear resistance hard particle, an anti-microbial additive, an anti-fungal additive, or an anti-algae additive.

In an embodiment, the film layer has a thickness of 5 mils to 20 mils. In an embodiment, the film layer has a thickness of 10 mils to 20 mils.

In an embodiment, the film layer is attached to both the first side and the second side of the substrate.

In one embodiment, the film layer is metallized.

In an embodiment, the roofing system further comprises a reinforcement layer. In one embodiment, the reinforcement layer comprises at least one of a scrim, a fiberglass mat or a polyester mat.

Another embodiment of this invention pertains to a method of preparing a fire-resistant roofing material. The method comprises (a) obtaining a substrate having a first side and a second side, and (b) applying a film layer to at least one of the first side or the second side of the substrate, the film layer comprising a polymer and having a thickness of 0.5 mils to 100 mils. A roofing material that includes the substrate having the applied film layer, when applied in a single layer and tested according to UL 790 and/or ASTM E-108 Standard Test Methods for Fire Tests of Roof Coverings, achieves a Class A rating for steep slope roofing systems.

In one embodiment, the applying the film layer to at least one of the first side or the second side of the substrate is conducted by applying at least one of a liquid coating or a powder coating of the film layer.

In an embodiment, the substrate comprises at least one of plywood, a scrim, a fiberglass mat, a polymer mat, or a hybrid mat. In another embodiment, the substrate comprises at least one of a polyolefin base mat or a polyester mat.

In one embodiment, the method further comprises applying a coating onto the substrate, with the coating comprising at least one of asphalt, a polymer-modified asphalt, or a non-asphaltic polymeric coating.

In one embodiment, the polymer comprises at least one of polyvinylidene fluoride (PVDF), polyvinyl chloride (PVC), or silicone.

In an embodiment, the film layer further comprises at least one of a filler, a pigment, a dye, a colorant, a fire retardant, a UV absorber, an anti-oxidant, a hindered amine light stabilizer (HALS), an impact modifier, a fiber, a wear resistance hard particle, an anti-microbial additive, an anti-fungal additive, or an anti-algae additive.

In an embodiment, the film layer has a thickness of 5 mils to 20 mils. In an embodiment, the film layer has a thickness of 10 mils to 20 mils.

In an embodiment, the applying the film layer to at least one of the first side or the second side of the substrate is conducted by applying the film layer to both the first side and the second side of the substrate.

In one embodiment, the method further comprises applying a reinforcement layer to the substrate. In one embodiment, the reinforcement layer comprises at least one of a scrim, a fiberglass mat or a polyester mat.

BRIEF DESCRIPTION OF THE FIGURES

For a more complete understanding of the invention and the advantages thereof, reference is made to the following descriptions, taken in conjunction with the accompanying figures, in which.

DETAILED DESCRIPTION OF THE INVENTION

Figure 1:
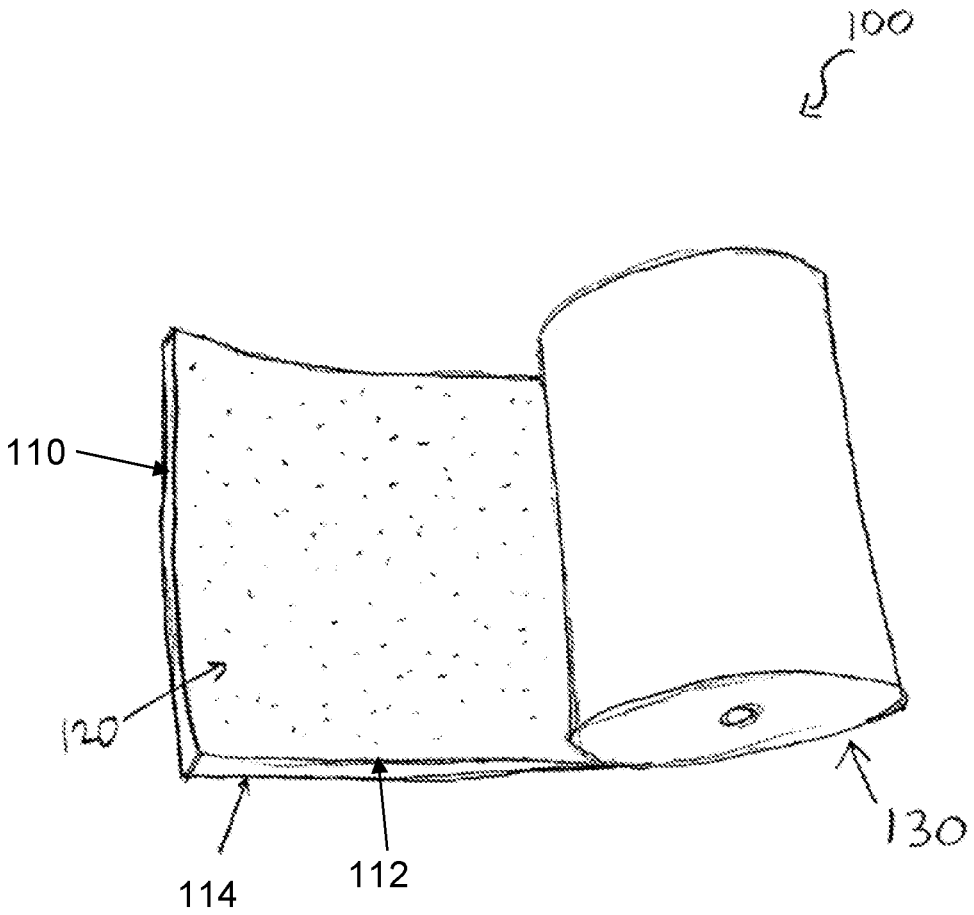
FIG. 1 is an illustration of a roll of roofing material according to an embodiment of the invention.

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising" "including," and "having" do not limit the scope of a specific claim to the materials or steps recited by the claim.

As used herein, terms such as "consisting of" and "composed of" limit the scope of a specific claim to the materials and steps recited by the claim.

All prior patents, publications, and test methods referenced herein are incorporated by reference in their entireties.

As used herein, the term "steep slope roofing system" and/or "steep slope roof deck" is any roofing system and/or roof deck that is disposed on a roof having a pitch of Y/X, where Y and X are in a ratio of 2:12 to 12:12, where Y corresponds to the "rise" of the roof, and where X corresponds to the "run" of the roof.

As used herein, the term "low slope roofing system" and/or "low slope roof deck" is any roofing system and/or roof deck that is disposed on a roof having a pitch of Y/X, where Y and X are in a ratio of 0.25:12 to 2:12, where Y corresponds to the "rise" of the roof, and where X corresponds to the "run" of the roof.

As used herein, the term "roofing material" includes, but is not limited to, shingles, waterproofing membranes, low slope membranes, underlayment, walkway pads, roofing accessories, flashings, solar panel backings, and tiles.

One embodiment of this invention pertains to a roll comprising a roofing material. The roofing material includes a substrate having a first side and a second side, and a film layer attached to at least one of the first side or the second side of the substrate, the film layer comprising a polymer and having a thickness of 0.5 mils to 100 mils. The roofing material, when applied in a single layer and tested according to UL 790 and/or ASTM E-108 Standard Test Methods for Fire Tests of Roof Coverings, achieves a Class A rating for steep slope roofing systems.

FIG. 1 illustrates a roll of roofing material 100 according to an embodiment of the invention. In this embodiment, the roll of roofing material 100 includes a substrate 110 having a first side 112 and a second side 114, and a film layer 120 attached to the first side 112 of the substrate 110. As shown in the embodiment of FIG. 1, the roofing material 100 is provided in roll form 130, which allows for, e.g., ease of storage, transportation, and/or installation. Although the embodiment of FIG. 1 illustrates the roofing material 100 in roll form 130, other forms are possible, including, e.g., panels, planks, etc., and other differing shapes.

In an embodiment, the substrate (e.g., substrate 110 of FIG. 1) comprises at least one of a scrim, a fiberglass mat, a polymer mat, or a hybrid mat. In another embodiment, the substrate (e.g., substrate 110 of FIG. 1) comprises at least one of a polyolefin base mat or a polyester mat.

In one embodiment, the substrate (e.g., substrate 110 of FIG. 1) includes a coating applied onto the substrate, and the coating comprises at least one of asphalt, a polymer-modified asphalt, or a non-asphaltic polymeric coating.

In one embodiment, the film layer (e.g., film layer 120 of FIG. 1) comprises a polymer. In an embodiment, the polymer comprises at least one of polyvinylidene fluoride (PVDF) or polyvinyl chloride (PVC). In an embodiment, the polymer includes, but is not limited to, fluoropolymers, polyolefins, halogenated polyolefins, polyamides, polyesters (PET), nylon, silicone, polyimides, polybenzoxazoles (PBOs), polybenzimidazoles, polybenzothiazoles (PBTs), thermoplastic polymers, thermoset polymers, engineered polymers, polymer films (including films comprised of graphene, expandable graphite, fire retardants, thermal and photo stabilizers, pigments, dyes, reflective pigments or dyes, or any combination thereof), embossed polymer films, previously structured polymer films, inorganic polymers, semi-organic polymers, inorganic-organic hybrid polymers, polymers comprising silicon-nitrogen, boron-nitrogen, phosphorus-nitrogen or a combination thereof, fire-resistant polymers, aramids (including, e.g., KEVLAR®, NOMEX®, TECHNORA®), silicones, and any combination of these polymers.

Other ingredients and/or additives may also be added to the film layer and/or the base (or substrate) layer to further modify its properties. In an embodiment, the film layer and/or the base (or substrate) layer further comprises at least one of a filler, a pigment, a dye, a colorant, a fire retardant, a UV absorber, an anti-oxidant, a hindered amine light stabilizer (HALS), an impact modifier, a fiber(s), a wear resistance hard particle(s) (e.g., having a Mohs Hardness greater than 3.5), an anti-microbial additive, an antifungal additive, or an anti-algae additive.

According to an embodiment, the film layer can be surface retreated to change the surface free energy.

In an embodiment, the film layer has a thickness of 0.5 mils to 100 mils. In an embodiment, the film layer has a thickness of 1 mil to 100 mils. In an embodiment, the film layer has a thickness of 5 mils to 100 mils. In an embodiment, the film layer has a thickness of 10 mils to 100 mils. In an embodiment, the film layer has a thickness of 25 mils to 100 mils. In an embodiment, the film layer has a thickness of 50 mils to 100 mils. In an embodiment, the film layer has a thickness of 75 mils to 100 mils. In an embodiment, the film layer has a thickness of 0.5 mils to 75 mils. In an embodiment, the film layer has a thickness of 1 mil to 75 mils. In an embodiment, the film layer has a thickness of 5 mils to 75 mils. In an embodiment, the film layer has a thickness of 10 mils to 75 mils. In an embodiment, the film layer has a thickness of 25 mils to 75 mils. In an embodiment, the film layer has a thickness of 50 mils to 75 mils. In an embodiment, the film layer has a thickness of 0.5 mils to 50 mils. In an embodiment, the film layer has a thickness of 1 mil to 50 mils. In an embodiment, the film layer has a thickness of 5 mils to 50 mils. In an embodiment, the film layer has a thickness of 10 mils to 50 mils. In an embodiment, the film layer has a thickness of 25 mils to 50 mils. In an embodiment, the film layer has a thickness of 0.5 mils to 25 mils. In an embodiment, the film layer has a thickness of 1 mil to 25 mils. In an embodiment, the film layer has a thickness of 5 mils to 25 mils. In an embodiment, the film layer has a thickness of 10 mils to 25 mils. In an embodiment, the film layer has a thickness of 0.5 mils to 20 mils. In an embodiment, the film layer has a thickness of 1 mil to 20 mils. In an embodiment, the film layer has a thickness of 5 mils to 20 mils. In an embodiment, the film layer has a thickness of 10 mils to 20 mils. In an embodiment, the film layer has a thickness of 15 mils to 20 mils. In an embodiment, the film layer has a thickness of 0.5 mils to 15 mils. In an embodiment, the film layer has a thickness of 1 mil to 15 mils. In an embodiment, the film layer has a thickness of 5 mils to 15 mils. In an embodiment, the film layer has a thickness of 10 mils to 15 mils. In an embodiment, the film layer has a thickness of 0.5 mils to 10 mils. In an embodiment, the film layer has a thickness of 1 mil to 10 mils. In an embodiment, the film layer has a thickness of 5 mils to 10 mils. In an embodiment, the film layer has a thickness of 0.5 mils to 5 mils. In an embodiment, the film layer has a thickness of 1 mil to 5 mils. In an embodiment, the film layer has a thickness of 0.5 mils to 1 mil.

Although the embodiment of FIG. 1 illustrates the film layer 120 being attached to only the first side 112 of the substrate 110, in another embodiment, the film layer 120 can be attached to the second side 114 of the substrate 110. In yet another embodiment, the film layer 120 can be attached to both the first side 112 and the second side 114 of the substrate 110.

In one embodiment, the film layer is metallized. In an embodiment, the metal used for metallizing the film layer can include any metal. In another embodiment, the metal used for metallizing the film layer includes, but is not limited to, aluminum, copper, silver, gold, platinum, and combinations thereof.

In an embodiment, the roofing material further comprises a reinforcement layer, which will be discussed further below (see also, e.g., FIGS. 2G and 2H). In one embodiment, the reinforcement layer comprises at least one of a scrim, a fiberglass mat or a polyester mat.

Another embodiment of this invention pertains to a roofing material that includes a substrate having a first side and a second side, and a film layer attached to at least one of the first side or the second side of the substrate, the film layer comprising a polymer and having a thickness of 0.5 mils to 100 mils. The roofing material, when applied in a single layer and tested according to UL 790 and/or ASTM E-108 Standard Test Methods for Fire Tests of Roof Coverings, achieves a Class A rating for steep slope roofing systems.

In an embodiment, the roofing material is a roofing shingle. According to one embodiment, the roofing shingle is one of (i) a single layer shingle or (ii) a laminated shingle having two or more layers.

In an embodiment, the roofing material further includes granules. In another embodiment, the roofing material further comprises fines.

Figure 2A:
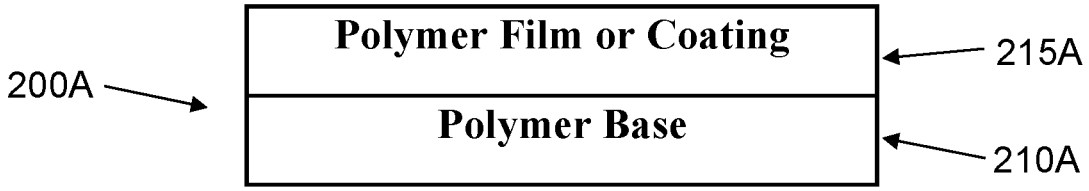
FIGS. 2A-2H are schematic illustrations of roofing materials having a polymeric film layer or coating according to various embodiments of the invention.
Figure 2B:
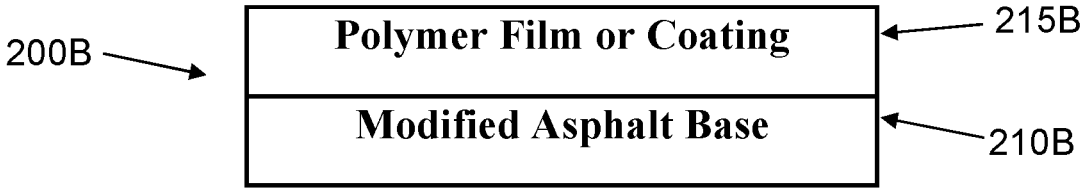
Figure 2C:
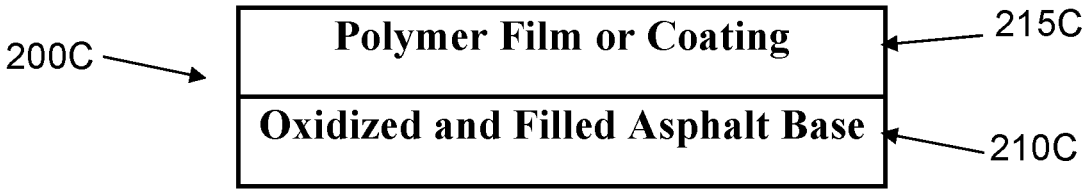
Figure 2D:
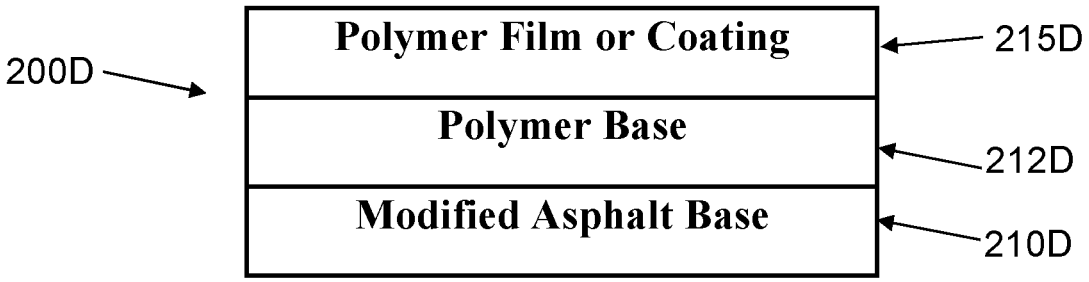
Figure 2E:
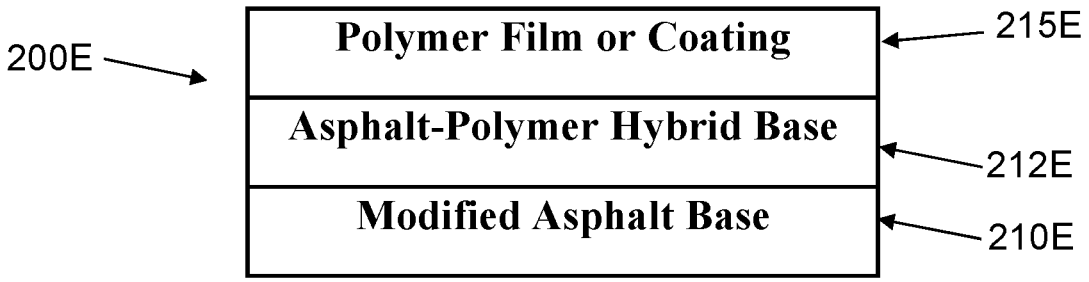
Figure 2F:
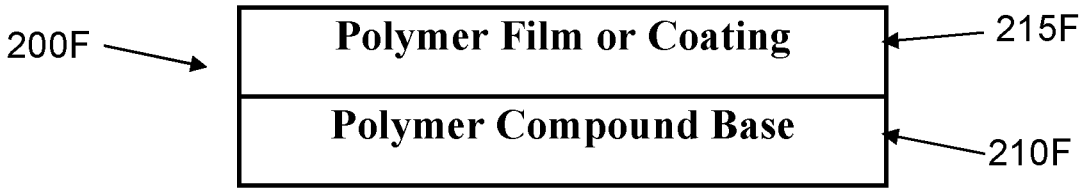
Figure 2G:
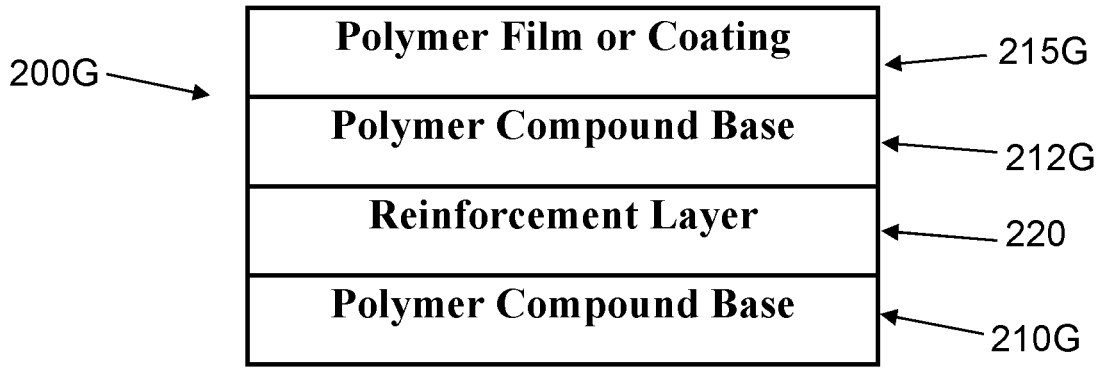
Figure 2H:
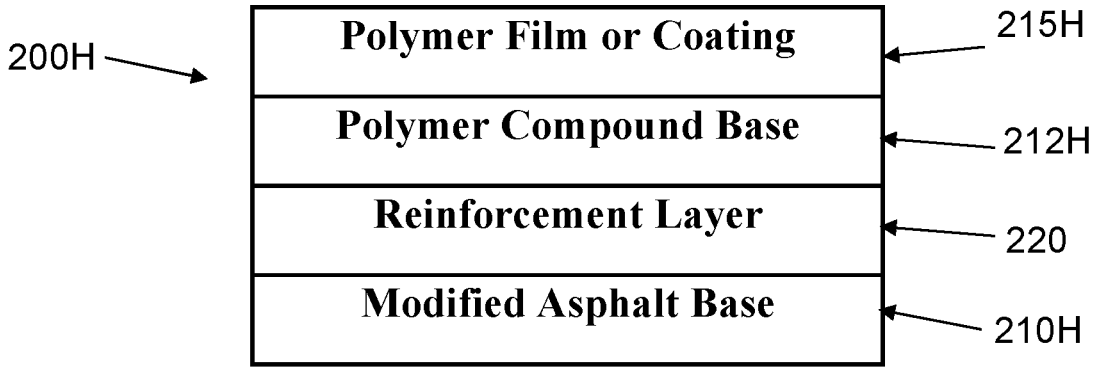

FIGS. 2A-2H illustrate various roofing materials having a polymeric film layer or coating according to embodiments of the invention. According to one embodiment, as shown in FIG. 2A, the roofing material 200A comprises a polymer base 210A having a top layer 215A comprising a polymer film or coating. According to another embodiment, as shown in FIG. 2B, the roofing material 200B comprises a modified asphalt base 210B having a top layer 215B comprising a polymer film or coating. According to another embodiment, as shown in FIG. 2C, the roofing material 200C comprises an oxidized and filled asphalt base 210C having a top layer 215C comprising a polymer film or coating. According to another embodiment, as shown in FIG. 2D, the roofing material 200D comprises at least two bases that include (i) a modified asphalt base 210D and (ii) a polymer base 212D, as well as a top layer 215D comprising a polymer film or coating. According to yet another embodiment, as shown in FIG. 2E, the roofing material 200E comprises at least two bases that include (i) a modified asphalt base 210E and (ii) an asphalt-polymer hybrid base 212E, as well as a top layer 215E comprising a polymer film or coating. According to another embodiment, as shown in FIG. 2F, the roofing material 200F comprises a polymer compound base 210F having a top layer 215F comprising a polymer film or coating. According to another embodiment, as shown in FIG. 2G, the roofing material 200G comprises at least two bases that include (i) a polymer compound base 210G and (ii) another polymer compound base 212G, with a reinforcement layer 220 between these two polymer compound bases (210G and 212G), as well as a top layer 215G comprising a polymer film or coating. According to yet another embodiment, as shown in FIG. 2H, the roofing material 200H comprises at least two bases that include (i) a modified asphalt base 210H and (ii) a polymer compound base 212H, with a reinforcement layer 220 between these two bases (210H and 212H), as well as a top layer 215H comprising a polymer film or coating.

Another embodiment of this invention pertains to a steep slope roofing system comprising a roof deck and a roofing material positioned above the roof deck. The roofing material includes a substrate having a first side and a second side, and a film layer attached to at least one of the first side or the second side of the substrate, the film layer comprising a polymer and having a thickness of 0.5 mils to 100 mils. The roof deck is a steep slope roof deck having a pitch of Y/X, wherein Y and X are in a ratio of 2:12 to 12:12, with Y corresponding to the rise of the roof and X corresponding to the run of the roof. The roofing system, when tested according to UL 790 and/or ASTM E-108 Standard Test Methods for Fire Tests of Roof Coverings, achieves a Class A rating for steep slope roofing systems. In an embodiment, the roof deck is a steep slope roof deck having a pitch of Y/X, wherein Y and X are in a ratio of 4:12 to 12:12, with Y corresponding to the rise of the roof and X corresponding to the run of the roof.

Figure 3:
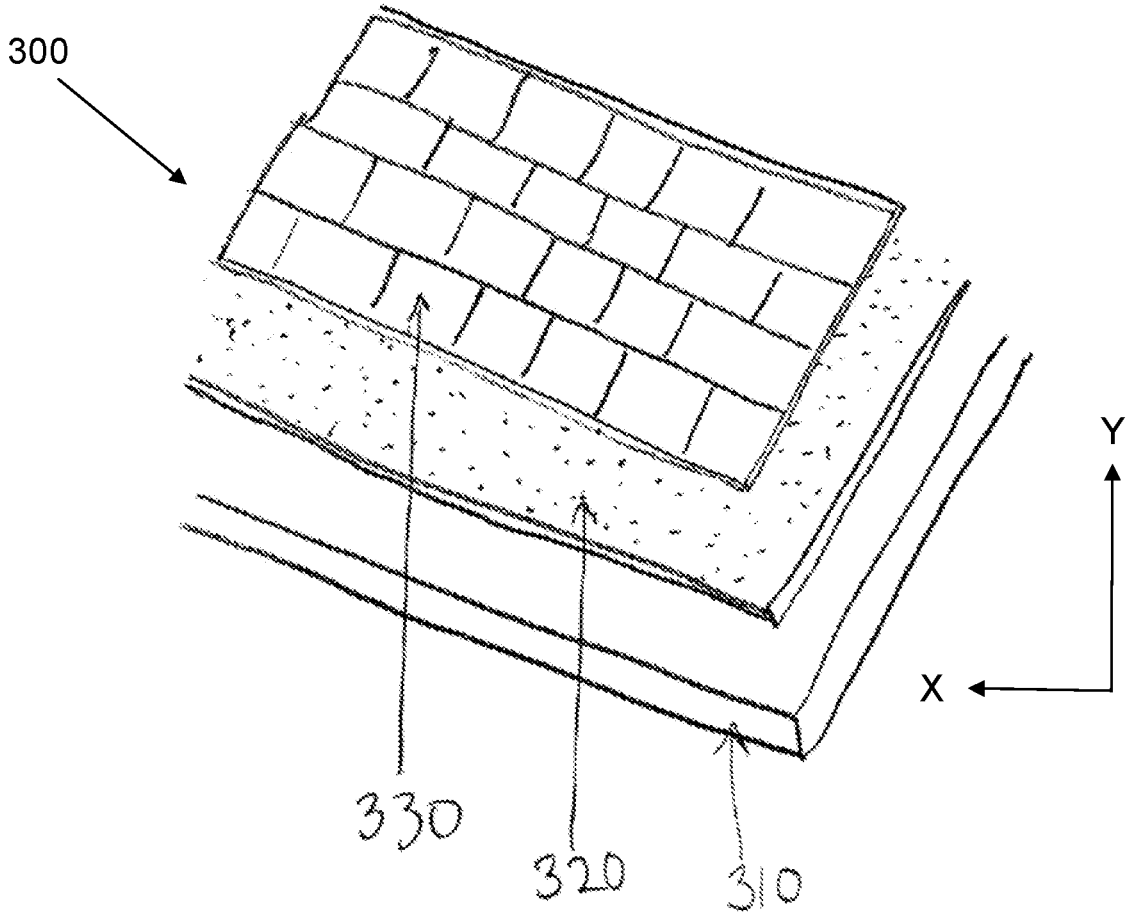
FIG. 3 is an illustration of a roofing system according to an embodiment of the invention.

FIG. 3 illustrates a steep slope roofing system 300 according to an embodiment of the invention. In this embodiment, the steep slope roofing system 300 includes a steep slope roof deck 310, which, as discussed above, has a pitch of Y/X, wherein Y and X are in a ratio of 2:12 to 12:12, with Y corresponding to the rise of the roof and X corresponding to the run of the roof. The roofing system 300 further includes a roofing material 320 positioned above the roof deck 310. The roofing material 320 comprises a substrate applied onto the roof deck 310, and a film layer attached to at least one side of the substrate (see, e.g., substrate 110 and film layer 120 of FIG. 1). As further shown in the embodiment of FIG. 3, the roofing system 300 can optionally include an additional roof covering 330. However, according to another embodiment, the roofing material 320 is the top layer of the roofing system 300 and a roof covering 330 is not included. According to another embodiment, the roofing system 300 can also include additional layers (not shown), such as, e.g., an insulating layer. According to an embodiment, one or more additional layers (not shown) can be positioned between the roofing material 320 and the roof deck 310.

In an embodiment, the roof deck is a steep slope roof deck having a pitch of Y/X, wherein Y and X are in a ratio of 2:12 to 12:12, with Y corresponding to the rise of the roof and X corresponding to the run of the roof. In an embodiment, the roof deck is a steep slope roof deck having a pitch of Y/X, wherein Y and X are in a ratio of 4:12 to 12:12, with Y corresponding to the rise of the roof and X corresponding to the run of the roof. In an embodiment, the roof deck is a steep slope roof deck having a pitch of Y/X, wherein Y and X are in a ratio of 6:12 to 12:12, with Y corresponding to the rise of the roof and X corresponding to the run of the roof. In an embodiment, the roof deck is a steep slope roof deck having a pitch of Y/X, wherein Y and X are in a ratio of 8:12 to 12:12, with Y corresponding to the rise of the roof and X corresponding to the run of the roof. In an embodiment, the roof deck is a steep slope roof deck having a pitch of Y/X, wherein Y and X are in a ratio of 10:12 to 12:12, with Y corresponding to the rise of the roof and X corresponding to the run of the roof.

According to an embodiment, a roofing material and/or a roofing system that achieves a Class A rating for steep slope roofing systems, when tested according to UL 790 and/or ASTM E-108 Standard Test Methods for Fire Tests of Roof Coverings, will also meet the requirements for a low slope roofing system.

Another embodiment of this invention pertains to method of preparing a fire-resistant roofing material. The method comprises (a) obtaining a substrate having a first side and a second side, and (b) applying a film layer to at least one of the first side or the second side of the substrate, the film layer comprising a polymer and having a thickness of 0.5 mils to 100 mils. A roofing material that includes the substrate having the applied film layer, when applied in a single layer and tested according to UL 790 and/or ASTM E-108 Standard Test Methods for Fire Tests of Roof Coverings, achieves a Class A rating for steep slope roofing systems.

In one embodiment, the applying the film layer to at least one of the first side or the second side of the substrate is achieved by applying at least one of a liquid coating or a powder coating of the film layer.

In an embodiment, the substrate comprises at least one of plywood, a scrim, a fiberglass mat, a polymer mat, or a hybrid mat.

In one embodiment, the method further comprises applying a coating onto the substrate, with the coating comprising at least one of asphalt, a polymer-modified asphalt, or a non-asphaltic polymeric coating.

In an embodiment, the applying the film layer to at least one of the first side or the second side of the substrate is achieved by applying the film layer to both the first side and the second side of the substrate.

According to an embodiment, the film layer can be applied (or attached) to the substrate as a solid polymeric film. According to another embodiment, the film layer can be applied as a liquid film coating that is hardened or cured into a solid film layer.

In one embodiment, the method further comprises applying a reinforcement layer to the substrate (see, e.g., FIGS. 2G and 2H).

Embodiments of the invention provide roofing materials with a polymer layer (e.g., films laminated or coating layers added) to polymeric, asphaltic, or asphalt-polymer hybrid bases. The polymer film layers or coatings can be designed to add fire performance, walkability, weathering resistance, impact resistance, design elements, colors, solar reflectivity, etc. The polymer film layers or coatings can be customized with designs, prints, and/or colors to match the surroundings to create a camouflaging effect.

According to an embodiment, roofing materials are prepared that comprise composites having a polymer film or coating layer on a polymeric, asphaltic, or hybrid base. The top layer, which comprises the polymer film or coating layer, can add desired physical properties and/or design elements to the composite without having to modify the base and/or can use a low-cost or engineered base with a high performing surface layer. According to an embodiment, the same base can be used and only the surface polymer film or coating layer can be adjusted or changed to fit different building construction product requirements, which can also provide, e.g., a cost effective custom solution for various roofing materials. According to another embodiment, the top layer, which comprises the polymer film or coating layer, can be tailored to meet the requirements for different building materials without changing the base. This type of construction allows for easy customization of the product. The composite also lends itself to use high recycle content in the base.

EXAMPLES

Specific embodiments of the invention will now be demonstrated by reference to the following examples. It should be understood that these examples are disclosed by way of illustrating the invention and should not be taken in any way to limit the scope of the present invention.

Example 1

Various roofing material samples for a steep slope roofing application were prepared according to embodiments of the invention. In particular, various composite roofing samples were prepared having a base/substrate of polyolefin or plywood, an optional glass or polyester reinforcement layer, and a polymer film, top layer of polyvinylidene difluoride (PVDF) or polyvinyl chloride (PVC) of differing thickness (see prepared samples in Table 1 below).

Typically, polyolefins do not have good fire resistance. However, as shown in the data of Table 1 below, adding a polymer film, top layer of PVDF or PVC film to a polyolefin base was found to improve the fire performance. Moreover, as also shown in the data of Table 1 below, the resistance to spread of flame increases as a function of the thickness of the PVDF film layer.

TABLE 1

| Top Film Layer | Base/Substrate | Reinforcement | Slope | Pass/Fail | Time (min) | Length (in) Flame |
|---|---|---|---|---|---|---|
| No Film | Polyolefin | Glass | 4:12 | FAIL | 2 | 12 |
| 5 mil PVDF Film | Polyolefin | Polyester | 4:12 | FAIL | 5 | 12 |
| 10 mil PVDF Film | Polyolefin | Polyester | 4:12 | PASS | 10 | 11 |
| 20 mil PVDF Film | Polyolefin | Polyester | 4:12 | PASS | 10 | 9.5 |
| 10 mil PVC Film | Polyolefin | Polyester | 4:12 | PASS | 10 | 10.5 |
| 5 mil PVDF Film | Plywood | None | 4:12 | PASS | 10 | 9.5 |

As further shown in the data and samples of Table 1 above, when a thin layer of PVDF film was attached to a plywood base, this composite also passed the spread flame requirement for a steep slope roofing application. In addition, as shown in the data and samples of Table 1 above, when PVC film is attached to a polyolefin base, this composite also passed the spread of flame requirement for a steep slope roofing application on a combustible deck.

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

We claim:

1. A roll comprising:

a roofing material, wherein the roofing material comprises:

(a) an uncoated substrate having a first side and a second side, the uncoated substrate comprising a polyolefin base mat, wherein the uncoated substrate is a bottom layer of the roofing material, such that the second side of the uncoated substrate is configured to directly contact a roof deck;

(b) a reinforcement layer having a first side and a second side, the second side of the reinforcement layer being attached to the first side of the uncoated substrate, wherein the reinforcement layer comprises at least one of a scrim, a fiberglass mat, or a polyester mat; and (c) a polymeric film layer directly attached to the first side of the reinforcement layer, wherein the polymeric film layer (i) consists essentially of at least one of polyvinyl chloride (PVC) or silicone, and (ii) has a thickness of 5 mils to 20 mils, and wherein the polymeric film layer is a top layer of the roofing material that is configured to directly contact a roofing shingle, wherein the roofing material, when applied in a single layer and tested according to at least one of UL 790 or ASTM E-108 Standard Test Methods for Fire Tests of Roof Coverings, achieves a Class A rating for steep slope roofing systems.

2. The roll according to claim 1, wherein the film layer has a thickness of 10 mils to 20 mils.

3. The roll according to claim 1, wherein the polymeric film layer is metallized.

4. A roofing material comprising:

(a) an uncoated substrate having a first side and a second side, the uncoated substrate comprising a polyolefin base mat, wherein the uncoated substrate is a bottom layer of the roofing material, such that the second side of the uncoated substrate is configured to directly contact a roof deck;

(b) a reinforcement layer having a first side and a second side, the second side of the reinforcement layer being attached to the first side of the uncoated substrate, wherein the reinforcement layer comprises at least one of a scrim, a fiberglass mat, or a polyester mat; and (c) a polymeric film layer directly attached to the first side of the reinforcement layer, wherein the polymeric film layer (i) consists essentially of at least one of polyvinyl chloride (PVC) or silicone, and (ii) has a thickness of 5 mils to 20 mils, wherein the polymeric film layer is a top layer of the roofing material that is configured to directly contact a roofing shingle, wherein the roofing material, when applied in a single layer and tested according to at least one of UL 790 or ASTM E-108 Standard Test Methods for Fire Tests of Roof Coverings, achieves a Class A rating for steep slope roofing systems.

5. The roofing material according to claim 4, wherein the polymeric film layer has a thickness of 10 mils to 20 mils.

6. The roofing material according to claim 4, wherein the roofing material comprises a roofing shingle.

7. The roofing material according to claim 6, wherein the roofing shingle is one of (i) a single layer shingle or (ii) a laminated shingle having two or more layers.

8. A steep slope roofing system comprising:

(a) a roof deck; and (b) a roofing material positioned above the roof deck, wherein the roofing material comprises:

(i) an uncoated substrate having a first side and a second side, the uncoated substrate comprising a polyolefin base mat, wherein the uncoated substrate is a bottom layer of the roofing material, such that the second side of the uncoated substrate directly contacts the roof deck;

(ii) a reinforcement layer having a first side and a second side, the second side of the reinforcement layer being attached to the first side of the uncoated substrate, wherein the reinforcement layer comprises at least one of a scrim, a fiberglass mat, or a polyester mat; and (iii) a polymeric film layer directly attached to the first side of the reinforcement layer, wherein the polymeric film layer (i) consists essentially of at least one of polyvinyl chloride (PVC) or silicone, and (ii) has a thickness of 5 mils to 20 mils, wherein the polymeric film layer is a top layer of the roofing material that is configured to directly contact a roofing shingle, wherein the roof deck is a steep slope roof deck having a pitch of Y/X, wherein Y and X are in a ratio of 2:12 to 12:12, with Y corresponding to the rise of the roof deck and X corresponding to the run of the roof deck, and wherein the roofing system, when tested according to at least one of UL 790 or ASTM E-108 Standard Test Methods for Fire Tests of Roof Coverings, achieves a Class A rating for steep slope roofing systems.

9. The steep slope roofing system according to claim 8, wherein the roof deck is a steep slope roof deck having a pitch of Y/X, wherein Y and X are in a ratio of 4:12 to 12:12, with Y corresponding to the rise of the roof deck and X corresponding to the run of the roof deck.

* * * * *